United States Patent [19]

Makita

[11] Patent Number: 4,859,092

[45] Date of Patent: Aug. 22, 1989

[54] PORTABLE APPARATUS WITH A MECHANISM FOR HOLDING A DISPLAY ABOVE A PRINTER WHILE THE PRINTER IS PRINTING DATA

[75] Inventor: Sadao Makita, Tokyo, Japan

[73] Assignee: Kabushiki Kaisha Toshiba, Kawasaki, Japan

[21] Appl. No.: 122,147

[22] Filed: Nov. 18, 1987

[30] Foreign Application Priority Data

Nov. 18, 1986 [JP] Japan ..... 61-176011[U]

[51] Int. Cl.[4] ..... B41J 3/46

[52] U.S. Cl. ..... 400/83; 400/680; 248/921; 248/923; 312/208; 312/327; D14/111; D14/113; D18/12

[58] Field of Search ..... 400/83, 680, 682, 683, 400/684, 685, 691, 693; 248/274, 276, 284, 442.2, 447, 454, 460, 462, 463, 464, 476, 479, 1 A, 1 B, 1 C, 1 D, 1 E, 1 F, 1 G, 1 H, 1 I, 1 J; 312/208, 294, 322, 323, 324, 325, 326, 327; 358/248, 249, 254; D14/106, 107, 111, 113, 114; D18/1, 12; 340/700, 711, 712; 364/708

[56] References Cited

U.S. PATENT DOCUMENTS

| | | | |
|---|---|---|---|
| 4,438,458 | 3/1984 | Munscher | 248/1 A |
| 4,545,555 | 10/1985 | Koch | 248/462 |
| 4,571,456 | 2/1986 | Paulsen et al. | 312/327 |
| 4,589,659 | 5/1986 | Yokoi et al. | 340/705 |
| 4,620,808 | 11/1986 | Kurtin et al. | 400/83 |
| 4,682,749 | 7/1987 | Strater | 248/454 |
| 4,693,525 | 9/1987 | Shinoto | 312/325 |
| 4,718,740 | 1/1988 | Cox | 312/325 |
| 4,736,332 | 4/1988 | Crease | 364/708 |
| 4,739,316 | 4/1988 | Yamaguchi et al. | 340/711 |
| 4,742,478 | 5/1988 | Nigro, Jr. et al. | 364/708 |

FOREIGN PATENT DOCUMENTS

| | | | |
|---|---|---|---|
| 188481 | 10/1984 | Japan | 400/83 |
| 151075 | 8/1985 | Japan | 400/680 |

OTHER PUBLICATIONS

G. C. Pechanek et al; "Briefcase-Portable Texturizer . . .."; IBM Tech. Disc. Bull.; vol. 27, No. 4A, pp. 2002-2004; Sep. 1984.

*Primary Examiner*—David A. Wiecking
*Attorney, Agent, or Firm*—Cushman, Darby & Cushman

[57] ABSTRACT

A portable typewriter, including keyboard and printer, is disclosed. It has a display pivotable about two axes which can be disposed in a position covering the keyboard. It can be pivoted about a first axis to reveal the keyboard, and can be further raised to reveal the printer.

18 Claims, 10 Drawing Sheets

PORTABLE APPARATUS WITH A MECHANISM FOR HOLDING A DISPLAY ABOVE A PRINTER WHILE THE PRINTER IS PRINTING DATA

BACKGROUND OF THE INVENTION

The present invention relates to a portable apparatus, and more particularly, to a portable apparatus having a keyboard, a display and a printer.

Recently, more and more portable devices, such as portable computers and portable word processors, are used since they are convenient and useful.

A portable computer has such a structure as is disclosed in U.S. Pat. No. 4,571,456. That is, it comprises a main body, a keyboard located in the front part of the main body, and a large flat-panel display rotatably connected to the keyboard by a hinge mechanism. When the portable computer is taken from one place to another, the flat-panel display is closed, thereby covering the keyboard. When an operator wishes to use the portable computer, the flat-panel display is lifted up to expose the keyboard.

Conventional portable computers are not provided with a printer. To print the data processed in the computer, the computer must be connected to a printer by means of a connector. The data cannot be printed in a place where a printer is not available.

SUMMARY OF THE INVENTION

One object of the present invention is to provide a portable apparatus having a flat-panel display and a printer.

Another object of the invention is to provide a portable apparatus which has a flat-panel display and a printer which makes it easy for an operator to set a sheet of paper in the printer.

To attain these objects, there is provided a portable apparatus having a main body, arms pivotably attached to the body and a display pivotably attached to the arms. The main body has a keyboard in the front and a printer in the rear. The arms are rotatable from a first position in which they lie along the body toward the keyboard to a second position in which they rise up from the body exposing the printer so that the display does not interfere with an operator using the printer. When the arms are in the first position, the display may be rotated from a position covering the keyboard to a position in which it is visible to an operator.

BRIEF DESCRIPTION OF THE DRAWINGS

These and other objects and features of the invention will become apparent to those skilled in the art as the disclosure is made in the following description of a preferred embodiment of the invention, as illustrated in the accompanying sheets of drawings, in which.

DETAILED DESCRIPTION OF THE PREFERRED EMBODIMENT

Figure 1:
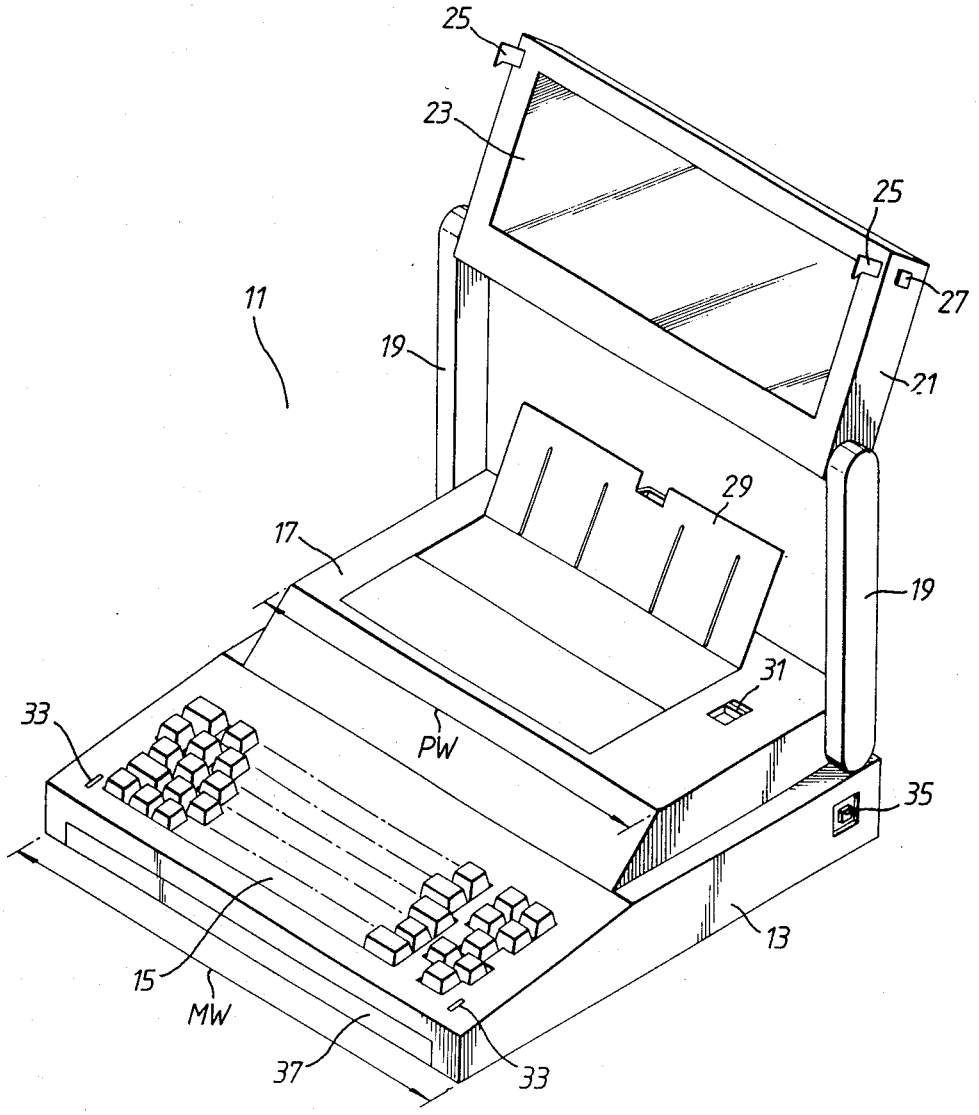
FIG. 1 is a perspective view of a portable apparatus according to the present invention, which has a keyboard and a display unit.

FIG. 1 shows the outer appearance of an embodiment of this invention, i.e., portable apparatus 11. Portable apparatus 11 has main body 13. Keyboard section 15, which is operated to input data, is provided on the front portion of main body 13. Printer section 17, which is a dot impact printer, a thermal transfer printer, or the like, is provided on the rear portion of main body 13. Printer section 17 has a width PW less than the width MW of main body 13. A pair of arms 19 are attached, at one of their ends, by means of first pins (not shown) to the rear portions of the left and right sides of main body 13, respectively. Both arms 19 can rotate about the first pins, with respect to main body 13 and printer section 17. The other ends of arms 19 are coupled by means of second pins (not shown) to the lower portions of the left and right sides of display unit 21, respectively. Hence, arms 19 support display unit 21.

Display unit 21 is a liquid crystal display, a plasma display, or the like. It can rotate around the second pins, with respect to arms 19. Unit 21 has screen 23 for displaying characters, images, etc. A pair of display-locking claws 25 protrude from that side of unit 21 on which screen 23 is provided. These claws 25 secure display unit 21 to main body 12 when unit 21 is laid onto keyboard section 15. Unit 21 has push button 27 for actuating display-locking claws 25.

Printer section 17 has cover 29 and lever 31. When printer section 17 is not used, cover 29 is closed, thus protecting the printer (not shown) located within printer section 17. When cover 29 is opened, a sheet of paper can be wrapped around the platen of the printer, and the printer can print data on this sheet of paper. Lever 31 is operated to set the sheet onto the platen, or to release the sheet from the platen.

A pair of display-locking holes 33 are cut in the upper surface of the front portion of main body 13. Display-locking claws 25 of display unit 21 are inserted into these holes 33 when unit 21 is laid onto keyboard section 15. Claws 25, push button 27, and holes 33 constitute a display-locking mechanism. Arm-locking switch 35 is provided on the rear portion of the right side of main body 13. This switch 35 is operated to set and release an arm-locking mechanism, described later, for locking arms 19. A slot is cut in the front end of main body 15. Through this slot, handle 37 can be pulled out of main body 15 and pushed back thereinto. Handle 37 is useful for carrying portable apparatus 11 from one place to another; it is pushed into main body 15 when apparatus 11 is used.

Figure 2:
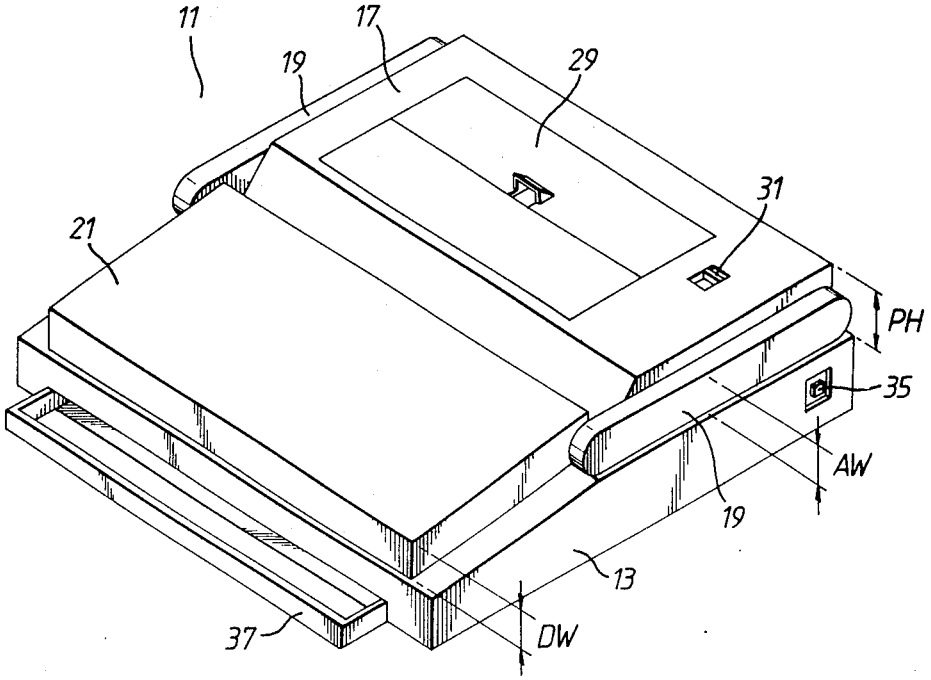
FIG. 2 is a perspective view showing the portable apparatus with the display unit covering the keyboard.

FIG. 2 shows portable apparatus 11, with display unit 21 laid on keyboard section 15, and handle 37 pulled out of main body 15. Display unit 21 and arms 19 supporting unit 21 are lowered onto main body 15 as is shown in FIG. 2. Then, portable apparatus 11 can easily be transported. In its lowered position, display unit 21 covers keyboard section 15. Display unit 21 has thickness DW substantially equal to height PH of printer section 17. Arms 19 have width AW which is also substantially equal to height PH of printer section 17. Therefore, when display unit 21 is closed, apparatus 11 will be shaped like a flat box. When handle 37 is pulled out of main body 13, portable appartus will look like an attache case.

Figure 3:
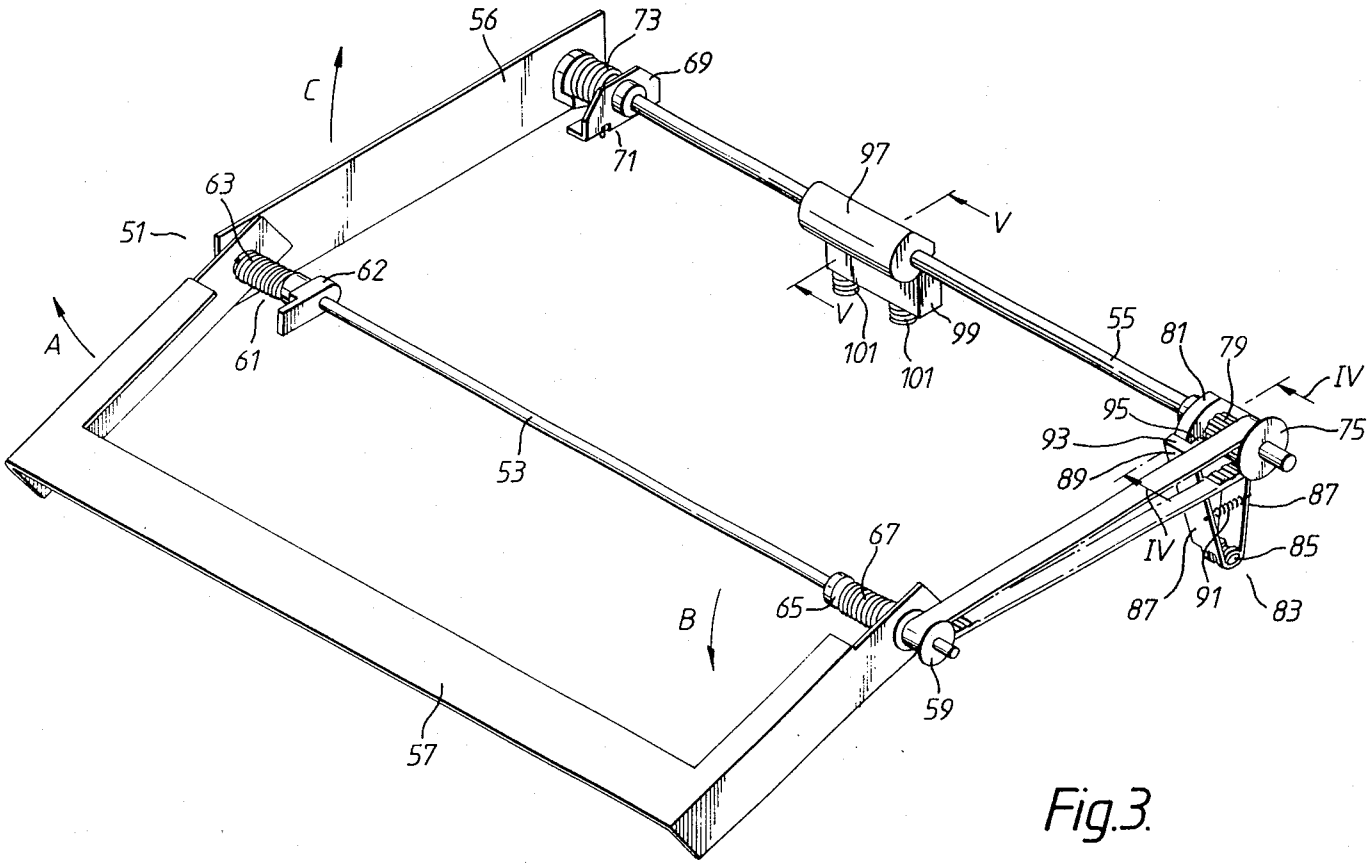
FIG. 3 is a perspective view of the display opening/-closing mechanism used in the apparatus of FIG. 1.

As is shown in FIG. 3, portable apparatus 11 further comprises mechanism 51 for opening and closing display unit 21. This mechanism 51 comprises first shaft 53 and second shaft 55. First shaft 53 supports display unit 21 such that unit 21 can rotate with respect to arms 19. Second shaft 55 supports display arms 19 such that both arms 19 can rotate with respect to main body 13. The left end of first shaft 53 is fixed to first plate 56 embedded in left arm 19. Similarly, the right end of first shaft 53 is fixed to second plate embedded in right arm 19. Second plate is not shown for the sake of illustration of other components of mechanism 51. Display-supporting frame 57 is attached to first shaft 53 such that frame 57 can rotate with respect to first and second plates 56. Display unit 21 is fitted in this frame 57. First pulley 59 is rotatably mounted on the right end portion of first shaft 53. Pulley 59 is attached to display-supporting frame 57 such that it rotates when frame 57 is rotated.

First shaft-locking mechanism 61 is mounted on the left end portion of first shaft 53. Pop-up cam 62 is rotatably mounted on shaft 53, to the right of first shaft-locking mechanism 61. First shaft-locking mechanism 61 has such a structure as is disclosed in Japanese Patent Disclosure No. 59-99111, and has coil spring 63. One end of coil spring 63 is fixed to display-supporting frame 57. The other end of spring 63 is fastened to pop-up cam 62. In the condition shown in FIG. 3, cam 62 contacts main body 13, and is unable to rotate. Coil spring 63, which is secured to frame 57 and cam 62, urges frame 57 upwardly. When display-supporting frame 57 is rotated in the direction of arrow A, coil spring 63 has its diameter reduced, thereby clamping first shaft 53. As a result, spring 63 holds frame 57 in a raised position.

Second shaft-locking mechanism 65 is mounted on the right end portion of first shaft 53. This mechanism 65 is identical in structure with the mechanism disclosed in Japanese Patent Disclosure No. 59-99111. It has coil spring 67. The right end of spring 67 is fastened to frame 57, and its left end is fixed to first shaft 53. When display-supporting frame 57 is rotated in the direction of arrow B, coil spring 67 has its diameter reduced, thereby clamping first shaft 53. As a result, spring 67 holds frame 57 in a lowered position.

Second shaft 55 is supported by holder 69, and is rotatable with respect to printer section 17. The left end of shaft 55 is fixed to first plate 56. The right end of shaft 55 is fixed to the second plate (not shown) embedded in display-supporting arm 19.

Third shaft-locking mechanism 71 is mounted on the left end portion of second shaft 55. This mechanism is also identical in structure to the mechanism disclosed in Japanese Patent Disclosure No. 59-99111. Third shaft-locking mechanism 71 has coil spring 73. The ends of coil spring 73 are fastened to first plate 56 and holder 69, respectively, such that it urges first and second plates 56 upward (the direction of arrow C) in the condition shown in FIG. 3. Second pulley 75 is rotatably mounted on the right end portion of second shaft 55.

Timing belt 77 is wrapped around first and second pulleys 59 and 75, coupling these pulleys. Gear 79 is mounted on second shaft 55. It is located to the left of second pulley 75 and integrally formed therewith. Hence, gear 79 can rotate on second shaft 55. Cam 81 is fixedly mounted on second shaft 55 and located to the left of gear 79. It therefore rotates when shaft 55 is rotated. Cam 81 is formed of two large-diameter sectors, two small-diameter sectors, and two intermediate sectors coupling the large- and small-diameter sectors and having a slightly inclined surface each. (Cam 81 will be described in detail, later.)

Stopper 83 is arranged below gear 79. Stopper 83 has pin hole 85, and has two stopper arms 87 extending from that portion having hole 85, two stopper claws 89 extending from the ends of arms 87, respectively, and spring 91 pulling arms 87 toward each other. Stopper claws 89 have contact 93 each, which can contact the large-diameter sectors or small-diameter sectors of cam 81. Stopper claws 89 also each have engagement portion 95, which is in mesh with gear 79 when the contacts 93 contact the small-diameter sectors of cam 81, and is released from gear 79 when the contacts 93 contact the large-diameter sectors of cam 81. Stopper 83 is supported within the housing of printer section 17 by a pin (not shown) extending from the inner side of the housing of printer section 17 and inserted in pin hole 85.

Latch cam 97 is fixedly mounted on the middle portion of second shaft 55, and rotates when second shaft 55 is rotated. This cam 97 has two tapered surfaces. Cam stopper 99 is arranged below latch cam 97. Cam stopper 99 has a latching surface contacting the tapered surfaces of cam 97. (The tapered surfaces of cam 97, and the latching surface of stopper 99 will be described in detail, later.) Compression spring 101 is provided below cam stopper 99, and pushes cam stopper 99 onto latch cam 97 at all times. Latch cam 97, cam stopper 99, and compression spring 101 constitute an arm-locking mechanism (later described).

Figure 4:
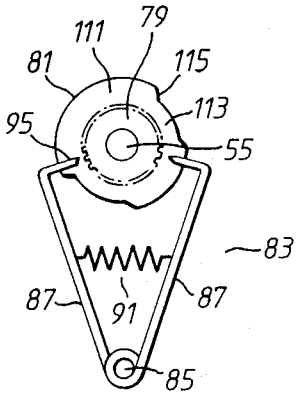
FIG. 4 is a cross-sectional view taken alogn line IV—IV in FIG. 3.

FIG. 4 is a cross-sectional view taken along IV-IV line in FIG. 3, showing the positional relationship which gear 79, cam 81 and stopper 83 assume when display opening/closing mechanism 11 is in the condition shown in FIG. 3.

As has been described, cam 81 consists of two large-diameter sectors 111, ttwo small-diameter sectors 113, and two intermediate sectors 115 coupling portins 111 and 113 and having a slightly inclined surface each.

When display-opening/closing mechanism 11 is in the condition shown in FIG. 3, it holds display unit 21 in the closed position. Both contacts 93 of stopper 83 are pressed onto the peripheries of large-diameter sectors 111 of cam 81. Hence, engagement portions 95 of stopper 83 are released from gear 79, and gear 79 and second pulley 75 integrally formed with gear 79 can freely rotate.

Figure 5:
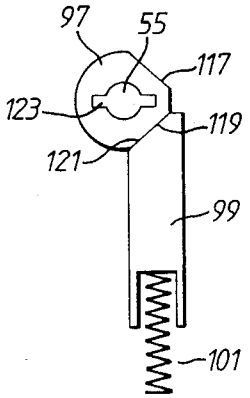
FIG. 5 is a cross-sectional view taken along line V—V in FIG. 3.

FIG. 5 is a cross-sectional view taken along the V-V line in FIG. 3, showing the positional relationship which latch cam 97 and cam stopper 99 take when display opening/closing mechanism 11 is in the condition shown in FIG. 3.

As has been descibed above, latch cam 97 has two tapered surfaces 117 and 119, and cam stopper 99 has latching surface 121. Second shaft 55 has cam stopper 123, which allows latch cam 97 to rotate together with second shaft 55.

When display opening/closing mechanism 51 is in the condition shown in FIG. 3, compression spring 101 pushes cam stopper 99 against tapered surface 119 of latch cam 97, and its latching surface 121 is kept in contact with tapered surface 119. Hence, cam stopper 99 is held by the arm-locking mechanism. Therefore, second shaft 55, which is integrally formed with latch cam 97, is prevented from rotating.

It will now be explained how display opening/closing mechanism 51 operates when an operator raises display unit 21 from keyboard section 15 so hat he or she may use portable apparatus 11.

Let us assume that the operator puts portable apparatus 11 on his desk, as is shown in FIG. 2, and then pushes handle 37 into main body 13. In order to raise display unit 21 from keyboard section 15, the operator pushes push button 27 of the display-locking mechanism, thereby unlocking display unit 21. Unit 21 pops up a little from keyboard section 15 since coil spring 63 of first shaft-locking mechanism 61 urges display-supporting frame 57.

Figure 6:
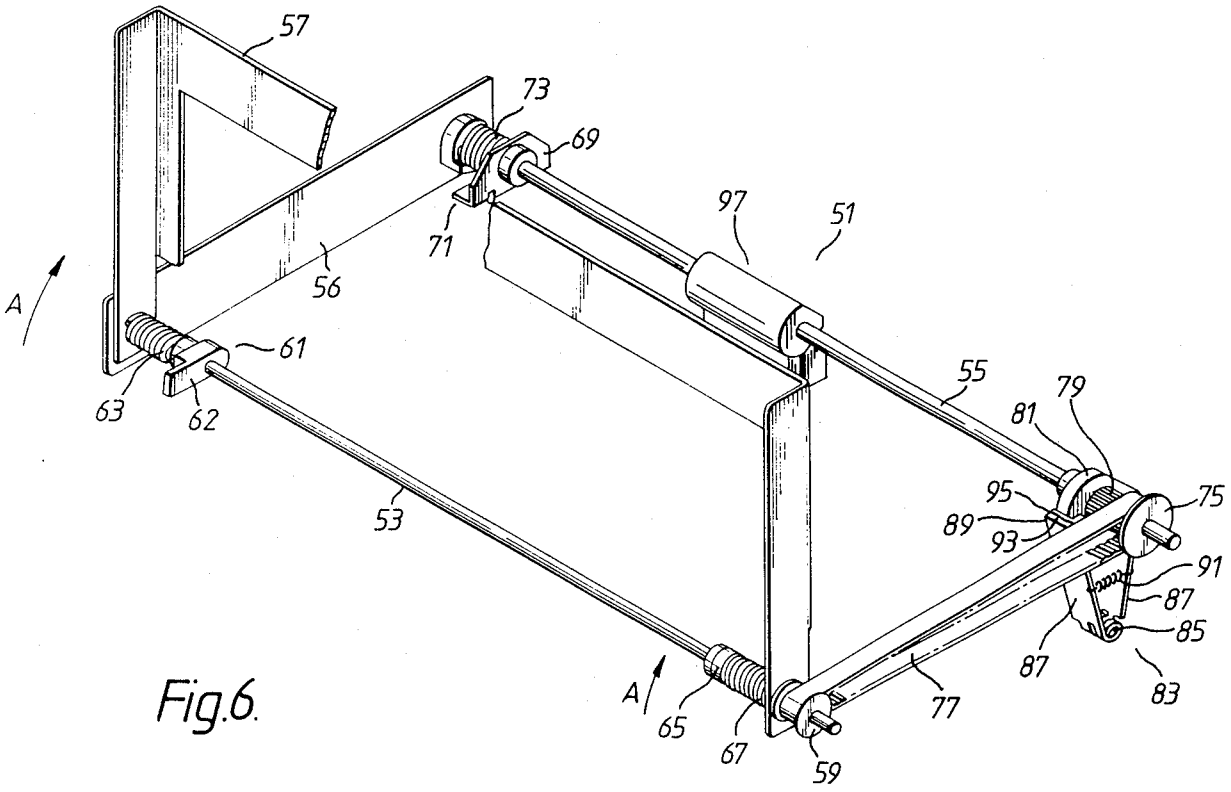
FIG. 6 is a perspective view showing the display opening/closing mechanism supporting the display unit in a raised position.

With reference to FIG. 6, it will be described how display opening/closing mechanism 51 operates to hold display unit 21 in a desired position.

When display unit 21 is unlocked, arms 19 still remain locked by the arm-locking mechanism. More specifically, latch cam 97 and cam stopper 99 remain in the condition shown in FIG. 5, thereby preventing second shaft 55 from rotating. Since second shaft 55 is unable to rotate, first and second plates 56 cannot rotate. For the same reason, cam 81 stays in the condition shown in FIG. 4. Therefore, gear 79 can rotate on second shaft 55. Second pulley 75, which is integrally formed with this gear 79, can also rotate. First pulley 59, which is coupled with second pulley 75 by timing belt 77, can also rotate. Hence, display-support frame 57 fixed to first pulley 59 can freely rotate around first shaft 53. That is, once display unit 21 has been unlocked, the componets of display opening/closing mechanism 51 prevent first and second plates 56 from rotating, and only display-supporting frame 57 can freely rotate around first shaft 53.

Figure 7:
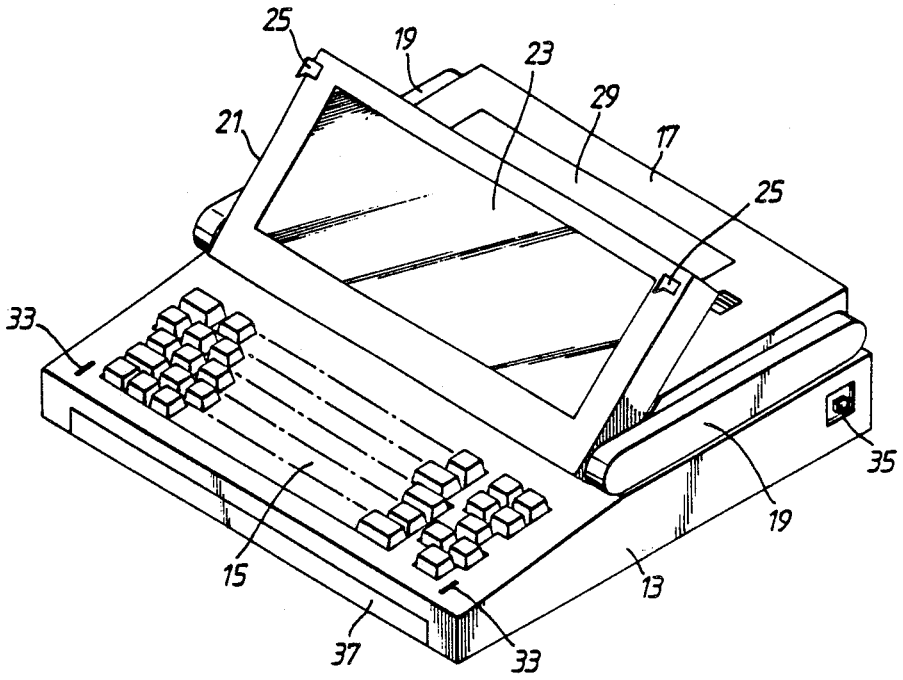
FIG. 7 is a perspective view of the portable apparatus, with the display unit supported by the mechanism in the raised position.
Figure 8:
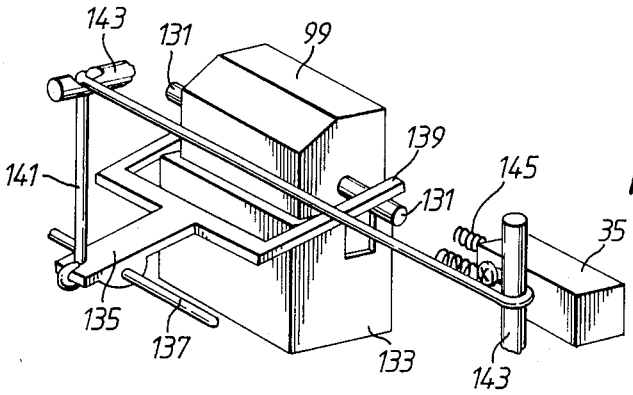
FIG. 8 is a perspective view of an arm-locking mechanism.

The operator can, therefore, raise display unit 21 from keyboard section 15 into such a desirable position, as is shown in FIG. 7, which is a perspective view showing portable apparatus 11. First shaft-locking mechanism 61 and second shaft-locking mechanism 65 lock display unit 21 in the desired raised position, holding unit 21 at a proper angle to main body 13.

Now it will be explained how display opening/closing mechanism 51 operates to raise display unit 21 further into a position right above printer section 17, so that the operator may easily operate printer section 17.

First the operator operates arm-locking switch 35, thereby unlocking both arms 19 supporting display unit 21. Then, the components of the arm-locking mechanism take the position shown in FIG. 9 thereby unlocking shaft 55 and plates 56 and therefore arms 19.

The arm-locking mechanism has stopper arms 131, cam stopper holder 133, arm push member 135, shaft 137, wire 141, wire guide 143 and springs 145. Stopper arms 131 project from each side wall of stopper 99. Arm push member 135 has two fingers 139 in one end portion and is rotatably supported by shaft 137. Fingers 139 contact upper portions of stopper arms 131. The other end portion of arm push member 135 connects with one end of wire 141. Wire 141 is guided by wire guide 143. The other end of wire 141 connects with switch 35. Springs 145 push switch 35. Shaft 137 and wire guide 143 are fixed in main body 13.

Figure 9:
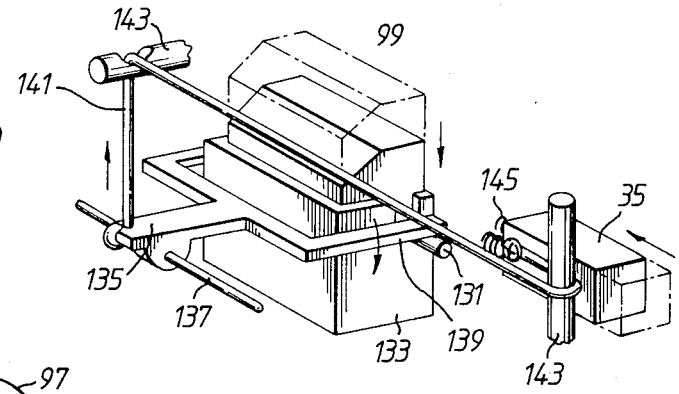
FIG. 9 is a diagram explaining how the arm-locking mechanism operates.

FIG. 9 is a diagram explaining how the arm-locking mechanism operates.

When an operator pushes switch 35 in the direction of the arrow, wire 141 pulls up the other end portion of arm push member 135 in the direction of the arrow. Arm push member 135 rotates about shaft 137. Finger 139 pushes down on stopper arms 131 in the direction of the arrow. Then cam stopper 99 moves in the direction of the arrow.

Figure 10:
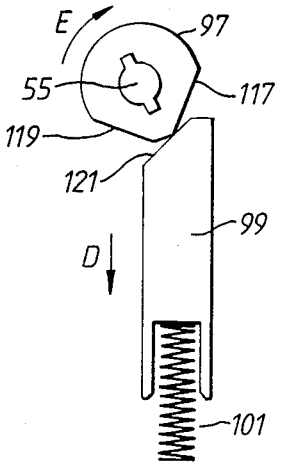
FIG. 10 is a diagram explaining how the latch cam and cam stopper of the arm-locking mechanism operate when the mechanism releases arms from a locked condition.

FIG. 10 is a diagram explaining how latch cam 97 and cam stopper 99 of the arm-locking mechanism operate when the mechanism releases arms 19 from a locked condition.

As has been explained with reference to FIG. 9, cam stopper 99 moves in the direction of arrow D (FIG. 10) against the force of compression spring 101 when arm-locking switch 35 is operated. As cam stopper 99 moves in this direction, its latching surface moves away from tapered surface 119 of latch cam 97. As a result, second shaft 55, on which cam 97 is fixedly mounted, can now be rotated in the direction of arrow E. Hence, second shaft, on which cam 97 is fixedly mounted, can now be rotated in the direction of arrow E. Hence, second shaft 55 is slightly rotated by coil spring 73 of third shaft-locking mechanism 71. First and second plates 56, both secured to second shaft 55, are raised a little, and both arms 19 are raised a little.

Figure 11:
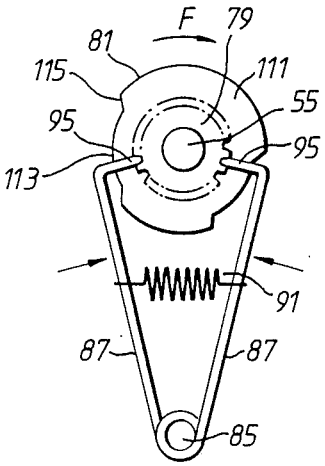
FIG. 11 is a diagram illustrating how the gear, latch cam and cam stopper of the arm-locking mechanism operate when the second shaft of the display-opening/-closing mechanism slightly rotates.

FIG. 11 shows the positioned relationship which gear 79, cam 81 and cam stopper 83 take when second and first plates 56 pop up a little. When second shaft 55 rotates in the direction of arrow E, cam 82 fixedly mounted on this shaft also rotates in the direction of arrow E. As a result, contacts 93 of cam stopper 83 are pressed onto the peripheries of small-diameter sectors 113 of cam 81, and stopper arms 87 of stopper cam 83 are pulled toward each other by spring 91. Engagement portions 95 of cam stopper 83 come into mesh with gear 79, thus preventing the rotation of gear 79. Then, second pulley 75, which is integrally formed with gear 79, can no longer rotate.

Figure 12:
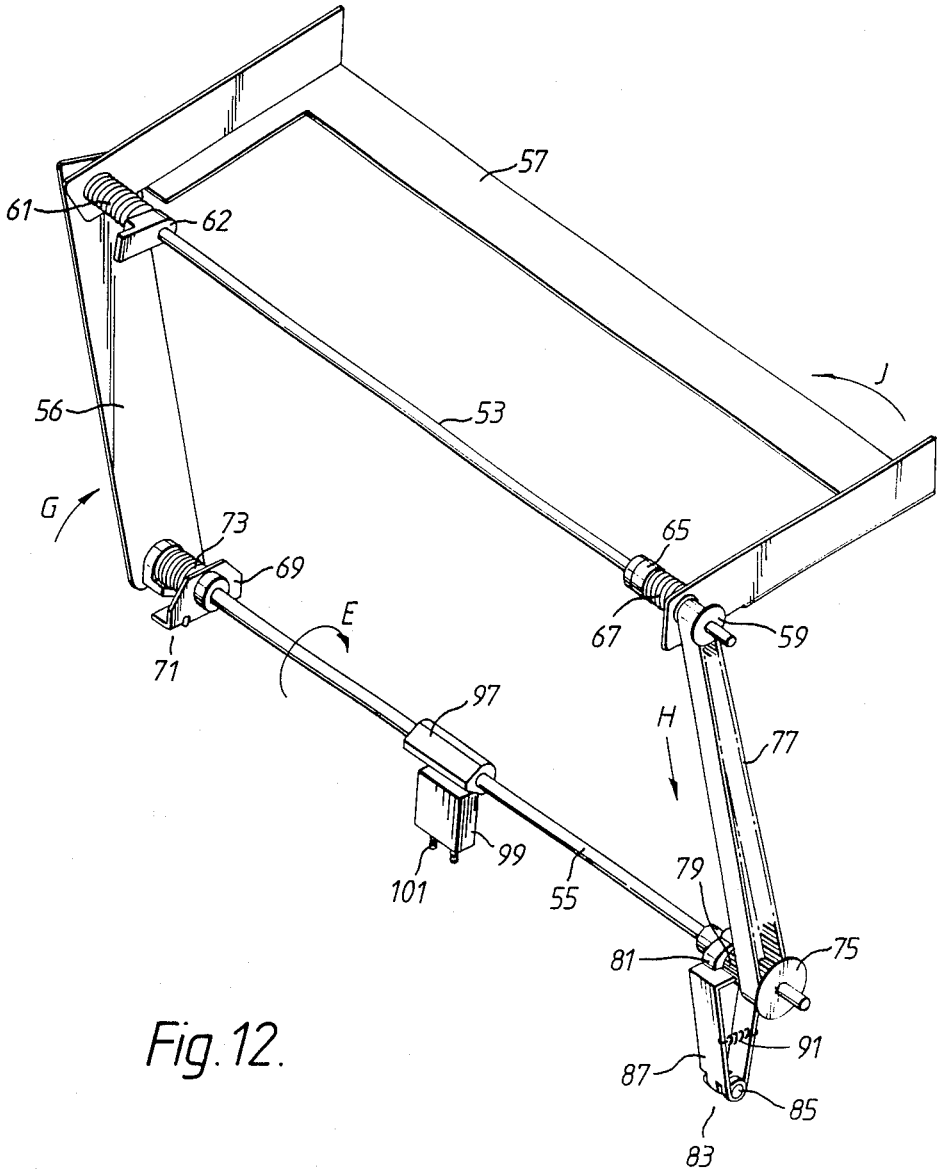
FIG. 12 is a perspective view of the display-opening/closing mechanism supporting the display unit above the printer section.

With reference to FIG. 12, it will now be described how display opening/closing mechanism 51 operates to hold display unit 21 above printer section 17.

Figure 13:
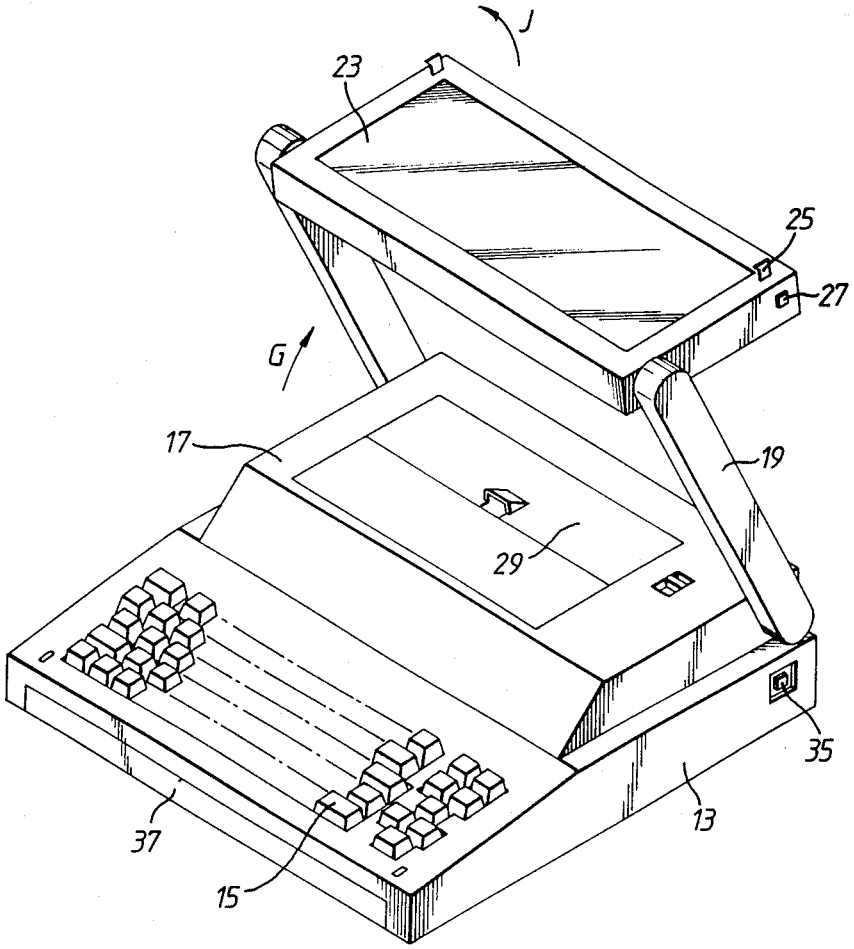
FIG. 13 is a perspective view of the apparatus showing the display opening/closing mechanism holding the display unit in a high position so that the printer mechanism can print paper.

Now that stopper 83 prevents second pulley 75 from rotating, both first and second plates 56 are no longer rotatable with respect to second shaft 55. FIG. 13 is a perspective view showing portable apparatus 11 in this condition. When plates 56 are rotated in the direction of arrow G (FIG. 12), timing belt 77 moves in the direction of arrow H, and display-supporting frame 57 rotates in the direction J (FIG. 12). As a result, display opening/closing mechanism 51 is changed from the position shown in FIG. 12 to the one shown in FIG. 14. Hence, portable apparatus 11 is also changed from the position shown in FIG. 12 to the one shown in FIG. 14. Hence, portable apparatus 11 is also changed from the position shown in FIG. 13 to the one shown in FIG. 1.

At the same time, second shaft 55, which is fastened to plates 56, rotates in the direction of arrow E (FIG. 12). When, after such rotation, display opening/closing mechanism 51 takes the position shown in FIG. 15, latch cam 97 and cam stopper 99 have such a positional relationship as is illustrated in FIG. 15, which is a cross-sectional view taken along line XV—XV in FIG. 14. As is shown in FIG. 15, cam stopper 99 is pushed upward by compression spring 101 the direction of arrow K when latch cam 97 is rotated as plates 56 are raised such that its tapered surface 117 moves to the position shown in FIG. 15. Latching surface of cam stopper 99 therefore comes into contact with tapered surface 117 of latch cam 97. As a result, second shaft 55 can no longer be rotatable.

Figure 14:
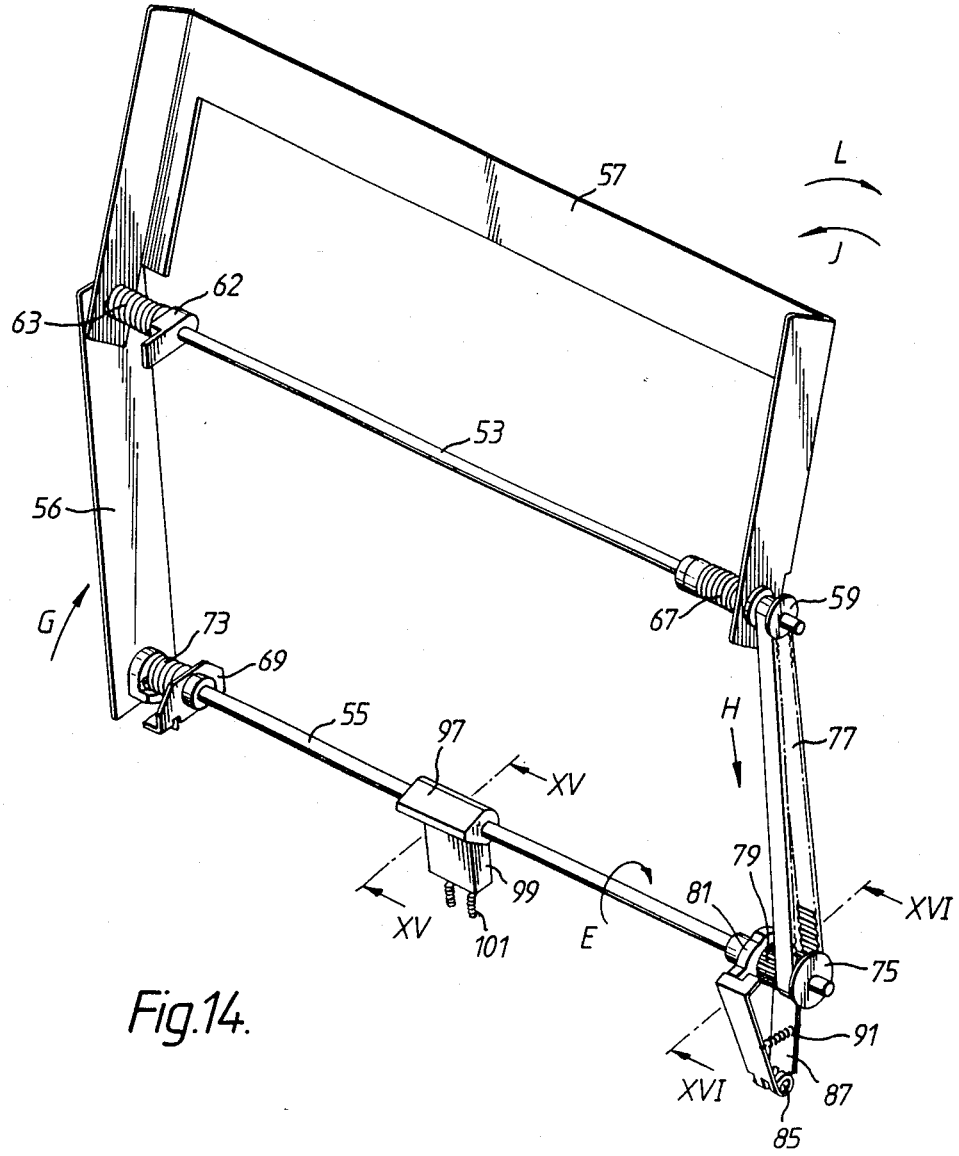
FIG. 14 is a perspective view showing the display-opening/closing mechanism holding the display unit higher above the keyboard than in the case shown in FIG. 13.
Figure 15:
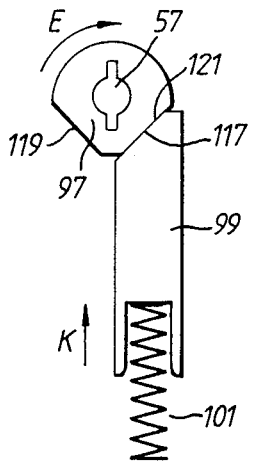
FIG. 15 is a cross-sectional view taken along line XV—XV in FIG. 14.
Figure 16:
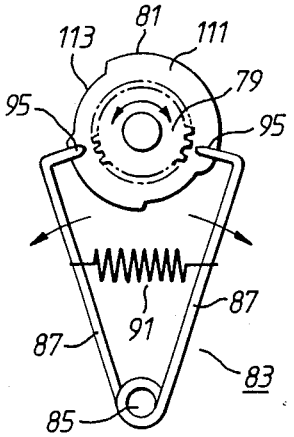
FIG. 16 is a cross-sectional view taken along line XVI—XVI in FIG. 14.

FIG. 16 is a cross-sectional view taken along the XVI—XVI line in FIG. 14, and illustrates the positional relationship which gear 79, cam 81 and stopper 83 have when display opening/closing mechanism 51 is in the condition shown in FIG. 14. As in shown in FIG. 16, contacts 93 contact the peripheries of large-diameter sectors 111 of cam 81. Stopper arms 87 are thus moved away from each other, and engagement portions 95 of stopper 83 are released from gear 79. Once engagement portions 95 have been released from gear 79, gear 79 and second pulley 75, which is integrally formed with gear 79, can rotate. Hence, first pulley 59, which is coupled to second pulley 75 by timing belt 77, can also rotate. In the condition of FIG. 14, display-supporting frame 57, which is fixed to first pulley 59, can be rotated around first shaft 53, due to the operation of first and second shaft-locking mechanism 61 and 65.

FIG. 1 is a perspective view of portable apparatus 11, with display unit 21 held in the highest position by display opening/closing mechanism 51 set in the condition of FIG. 14. As shown in this figure, display unit 21 is raised such that the operator can see printer section 17 and can also see the data displayed on unit 21 while he is operating keyboard section 15. This helps to increase efficiency in wrapping a sheet of paper around the platen of the printer, printing data on the sheet, and inputting data. In addition, since printer section 17 and display unit 21 are closely arranged, portable apparatus 11 can be smaller than would be necessary otherwise.

Figure 17:
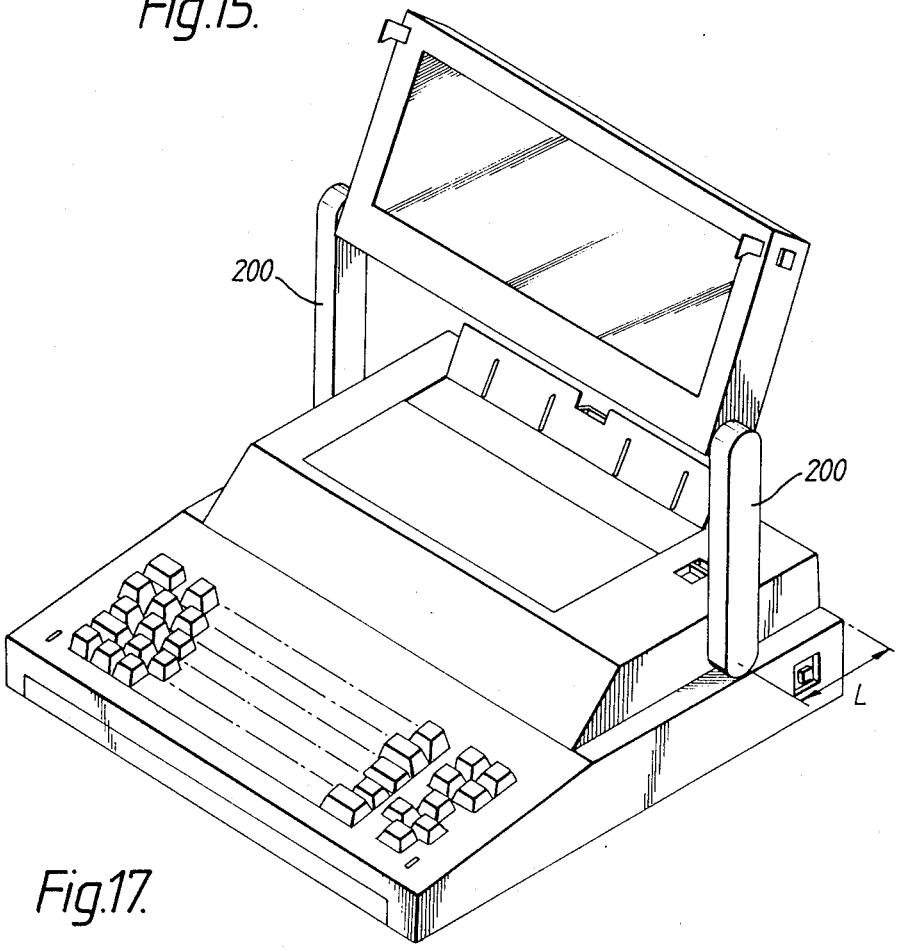
FIG. 17 is a perspective view of an alternative embodiment of the present invention.

FIG. 17 shows the outer appearance of another embodiment of this invention.

In this embodiment, a pair of arms 200 are attached to side portions separated from the rear end of the main body 13. The length of the side portions from the rear end is L. This embodiment has the same effect of the embodiment of FIGS. 1–16.

What is claimed is:

1. A portable apparatus comprising:

a main body having a keyboard toward a front of said main body and a printer toward a rear of said main body;

a display housing for containing a display, adapted to mate with said front of said main body to form a cover for said keyboard;

first mounting means for mounting said display housing to rotate about a first axis; and second mounting means for mounting said first mounting means to rotate about a second axis, said first mounting means being rotatable between a first position adjacent to said keyboard and a second position which exposes said printer, said display housing being rotatable to mate with said main body and cover said keyboard in one position and to face said display to be visible to an operator in another position when said first mounting means is in said first position.

2. A portable apparatus according to claim 1 further comprising means for latching said first mounting means in said second position.

3. A portable apparatus according to claim 1 further comprising latching means for latching said first mounting means in either of said first position or said second position.

4. A portable apparatus according to claim 1 further comprising rotating means for automatically rotating said display housing about said first axis as said first mounting means is rotated about said second mounting means.

5. A portable apparatus according to claim 4 wherein said rotating means includes means for automatically rotating said display for only a portion of rotation of said first mounting means between said first position and said second position.

6. An apparatus as in claim 1 wherein rotation about said first axis defines a first plane, and rotation about said second axis defines a second plane, said first plane being parallel to said second plane and perpendicular to a plane defined by said display.

7. An apparatus as in claim 1 wherein said display housing is formed with display locking claws on one surface thereof, and said main body is formed with a plurality of display locking holes on a top surface thereof, said display locking claws mating with said display locking holes to cover and lock said keyboard.

8. An apparatus as in claim 7 wherein said display housing is formed of a size to completely cover all of said keyboard.

9. An apparatus as in claim 8 wherein said display housing has two substantially flat surfaces, parallel to one another, one of said flat surfaces including said display and said display locking claws, and another of said flat surfaces forming a cover for said keyboard.

10. A portable apparatus comprising:

a main body having a keyboard toward a front of said main body and a printer toward a rear of said main body:

a housing for containing a display, adapted to mate with said front of said main body to form a cover for said keyboard; and at least one arm, one end of said at least one arm being pivotably attached to said body and another end of said at least one arm being pivotably attached to said display;

first means for mounting said arm to pivot relative to said body between a first position in which said display housing is adjacent said keyboard and a second position in which said display housing exposes said printer; and second means for mounting said display housing to be pivotable between one position in which said display housing mates with said main body, covering said keyboard, and another position in which an operator can see said display when said at least one arm is in said first position.

11. A portable apparatus according to claim 10 further comprising means for latching said arm in second position.

12. A portable apparatus according to claim 10 further comprising latching means for latching said arm in either of said first position or said second position.

13. A portable apparatus according to claim 10 further comprising:

a first rotatable pulley rotatably fixed to said main body and concentric with an axis of rotation of said arm relative to said body;

a second pulley fixed to said display and concentric with an axis of rotation of said display relative to said arm; and a belt interconnecting said first pulley and said second pulley.

14. A portable apparatus according to claim 13 wherein said first pulley is rotatable relative to said body and said apparatus includes means for preventing rotation of said first pulley relative to said body for a portion of rotation of said arm between said first position and said second position.

15. An apparatus as in claim 10 wherein rotation about said first means defines a first plane, and rotation about said second means defines a second plane, said first plane being parallel to said second plane and perpendicular to a plane defined by said display.

16. An apparatus as in claim 10 wherein said display housing is formed with display locking claws on one surface thereof, and said main body is formed with a plurality of display locking holes on a top surface thereof, said display locking claws mating with said display locking holes to cover and lock said keyboard.

17. An apparatus as in claim 16 wherein said display housing is formed of a size to completely cover all of said keyboard.

18. An apparatus as in claim 17 wherein said display housing has two substantially flat surfaces, parallel to one another, one of said flat surfaces including said display and said display locking claws, and another of said flat surfaces forming a cover for said keyboard.

* * * * *